US007971392B2

(12) United States Patent
Seo

(10) Patent No.: US 7,971,392 B2
(45) Date of Patent: Jul. 5, 2011

(54) OPENING AND CLOSING DEVICE FOR LIFT-UP SLIDING DOORS AND WINDOWS

(75) Inventor: Song-Won Seo, Daejeon-si (KR)

(73) Assignee: LG Chem, Ltd. (KR)

( * ) Notice: Subject to any disclaimer, the term of this patent is extended or adjusted under 35 U.S.C. 154(b) by 201 days.

(21) Appl. No.: 11/576,710

(22) PCT Filed: Aug. 25, 2006

(86) PCT No.: PCT/KR2006/003355

§ 371 (c)(1),
(2), (4) Date: Apr. 5, 2007

(87) PCT Pub. No.: WO2007/073027

PCT Pub. Date: Jun. 28, 2007

(65) Prior Publication Data

US 2009/0013605 A1 Jan. 15, 2009

(30) Foreign Application Priority Data

Dec. 21, 2005 (KR) ..... 10-2005-0127054
Jun. 28, 2006 (KR) ..... 10-2006-0058719

(51) Int. Cl.
*E05D 15/10* (2006.01)

(52) U.S. Cl. ..... 49/221; 49/209; 49/235; 49/425

(58) Field of Classification Search ..... 49/209, 49/221, 224, 226, 234, 235, 425
See application file for complete search history.

(56) References Cited

U.S. PATENT DOCUMENTS

| | | | | |
|---|---|---|---|---|
| 5,012,611 | A * | 5/1991 | Hsu | 49/225 |
| 5,102,174 | A | 4/1992 | Prevot | |
| 6,049,986 | A * | 4/2000 | Calkins et al. | 30/386 |
| 6,062,612 | A * | 5/2000 | Lin | 292/144 |
| 6,782,661 | B2 * | 8/2004 | Manzella | 49/192 |
| 2004/0163317 | A1 | 8/2004 | Reich et al. | |

FOREIGN PATENT DOCUMENTS

| | | |
|---|---|---|
| JP | 0113670 A | 4/2005 |
| KR | 200349119 | 4/2004 |

OTHER PUBLICATIONS

International Search Report; PCT/KR2006/003355; Dec. 21, 2005.
Written Opinion of the International Searching Authority; PCT/KR2006/003355; Nov. 22, 2006.
CN Office Action issued Jun. 12, 2010; 200680000782.2.

* cited by examiner

*Primary Examiner* — Gregory J. Strimbu
(74) *Attorney, Agent, or Firm* — Cantor Colburn LLP

(57) ABSTRACT

An opening and closing device includes a roller unit (10) which movably contacts a rail (203*b*) of a support frame (203), a pane frame support unit (20) which is provided in a pane frame (205) and moves away from and approaches the roller unit, a handle (5), which is rotatably provided on a leading end of the pane frame wherein rotation of the handle moves the roller unit relative to the pane frame support unit which causes the pane frame support unit and the pane frame to move vertically relative to the roller unit.

13 Claims, 13 Drawing Sheets

OPENING AND CLOSING DEVICE FOR LIFT-UP SLIDING DOORS AND WINDOWS

This application claims the benefit of the filing date of Korean Patent Application No. 10-2005-0127054 filed on Dec. 21, 2005 and 10-2005-0058719 filed on Jun. 28, 2006, in the Korean Intellectual Property Office, the disclosure of which is incorporated herein in its entirety by reference.

TECHNICAL FIELD

The present invention relates, in general, to opening and closing devices for lift-up sliding doors and windows and, more particularly, to an opening and closing device for lift-up sliding doors and windows which has improved structure and performance.

BACKGROUND ART

Generally, lift-up sliding type doors and windows, which are used as relatively large doors and windows, such as patio doors connecting living rooms to balconies, have advantages in that the sliding motion for opening or closing can be smoothly and quietly conducted, airtightness and watertightness are ensured, and soundproofing and crime prevention effects are superior.

FIG. 1 shows a representative example of such lift-up sliding type doors and windows. As shown in FIG. 1, a conventional lift-up sliding type door or window 201 includes a support frame 203 having an opening 203*a*, a pane frame 205 which supports a sheet of pane glass 205*a* and is slidably provided in the support frame 203 to openably close the support frame 203, and an opening and closing device 101 which locks or releases the pane frame 205, which slides to open or close.

In response to the rotation of a handle 120 provided at a predetermined position on the pane frame 205, the opening and closing device 101 allows the pane frame 205 to slide along a rail 203*b* of the support frame 203 while being spaced apart from the rail 203*b*, or allows the pane frame 205 to come into close contact with the rail 203*b* of the support frame 203 due to its own weight such that the pane frame 205 is prevented from sliding along the rail 203*b*. The minimization of noise during the process of sliding the pane frame 205, convenience of opening and closing manipulation, airtightness, watertightness, and soundproofing and crime prevention effects are determined by the performance of the opening and closing device 101.

To achieve the above-mentioned purposes, recently, various techniques for improving opening and closing devices for lift-up sliding doors and windows have been developed. A representative example of such techniques was disclosed in Korean Utility Model Registration No. 20-0349119, shown in FIGS. 2 through 4.

As shown in the drawings, a conventional opening and closing device 101 for lift-up sliding doors and windows includes a pair of roller units 110, which are provided in a lower end of a pane frame (205 of FIG. 1). The roller units 110 slide the pane frame 205 along a rail 203*b* of a support frame 203 and move the pane frame 205 in directions away from or approaching the rail 203*b*. The opening and closing device 101 further includes a handle 120, which is rotatably provided in a leading end of the pane frame 205, and a handle assembly 130, which has a plurality of gears 131 and a gear link 133 for converting rotation of the handle 120 into linear motion and has a pull slider 135. The opening and closing device 101 further includes an upper connection link 140, which couples the gear link 133 to the handle assembly 130, and a damping spring 150, which absorbs shocks generated when the pane frame 205 vertically moves.

In the conventional opening and closing device 101 having the above-mentioned construction, when the handle 120 is rotated in one direction by manipulation of a user, the operating force is transmitted to the gear link 133 through the gears 131, which are provided in the handle assembly 130 and engage with each other, and thus is converted into upward linear motion of the gear link 133 before being transmitted to the pull slider 135, which is coupled to the gear link 133.

Then, as shown in FIG. 4, the upper connection link 140, which is coupled to the pull slider 135, is moved upwards, so that a pane frame support member 111 of the roller unit 110 is moved away from rollers 113. Thus, the pane frame 205 enters a slidable state, in which it is spaced apart from the rail 203*b* of the support frame 203.

At this time, the weight of the pane frame 205 is reduced by the damping spring 150 while the pane frame 205 is moved away from the rail 203*b* of the support frame 203. After the pane frame 205 enters the lifted state, the pull slider 135 is locked to a stopper 137, thus maintaining the upper connection link 140 in the upward moved state, that is, maintaining the pane frame 205 in the state of being spaced apart from the rail 203*b* of the support frame 203. Thereafter, when the user releases the handle 120, the gears 131 are rotated in the opposite direction by a spring, so that the handle 120 is returned to the initial position thereof.

Furthermore, when the pane frame support member 111 is moved upwards away from the rollers 113, a guide roller 173, which is provided on a support plate 171, which rotatably supports the rollers 113, is moved downwards along a linear lift guide slot 175, which is formed at a lower position in the pane frame support member 111 at an incline.

Meanwhile, when a switch 138 of the handle assembly 130 is brought into contact with a striker 160 by closing the pane frame 205 and thus is pushed inwards, or when the switch 138 is forcibly pushed inwards to maintain a desired opened position of the pane frame 205, the stopper 137 is operated through a switch link 139 in the unlocking direction. Thus, the pull slider 135 is released from the stopper 137.

Then, as shown in FIG. 3, the upper connection link 140, which is coupled to the pull slider 135, is moved downwards, and the pane frame support member 111 of the roller unit 110 is moved towards the rollers 113. Thus, the pane frame 205 is brought into close contact with the rail 203*b* of the support frame 203. As a result, the pane frame 205 enters the stationary state due to its own weight.

At this time, the weight of the pane frame 205 is damped by the damping spring 150 while the pane frame 205 is brought into contact with the rail 203*b* of the support frame 203. Furthermore, in the closed state, in which the pane frame 205 contacts the support frame 203, a locking spring 135*a* of the pull slider 135 engages with a locking protrusion (170 of FIG. 2) of the striker (160 of FIG. 2), which is fastened to the support frame 203, so that the pane frame 205 is automatically locked. In the open state, the pane frame 205 is maintained at the opened position thereof by its own weight.

Furthermore, when the pane frame support member 111 is moved downwards towards the rollers 113, the guide roller 173, which is provided on the support plate 171, which rotatably supports the rollers 113, is moved upwards along the linear lift guide slot 175, which is formed at a lower position in the pane frame support member 111 at an incline.

However, in the conventional opening and closing device for lift-up sliding doors and windows, a complex gear mechanism and a separate damping spring are required to reduce the operating force required to move the pane frame upwards and downwards away from and onto the rail of the support frame. Therefore, there is a problem in that the structure of the mechanism for reducing the operating force is very complex.

Furthermore, because the gear link and the pull slider are required for transmitting force from the gears to the upper connection link, the structure for operating the upper connection link is also complex.

As well, the structure for locking the pane frame, that is, the structure for locking and releasing the pull slider to and from the stopper, is also very complex.

As such, due to the complex structure of the device, the process of manufacturing the device is also complicated, and manufacturing costs thereof are increased.

Moreover, when the pane frame support member is moved upwards with respect to the rollers, the guide roller is linearly moved along the lift guide slot, which is formed at a lower position in the pane frame support member at an incline. Here, because the lift guide slot is linearly formed at an incline, the weight of the pane frame cannot be dispersed, but is continuously applied towards the lower end of the lift guide slot (in the direction of the arrow "H", shown in the partially enlarged view of FIGS. 3 and 4). Therefore, there is a problem in that the force required to rotate the handle and the force required to operate the gears, that is, the force required to open and close the pane frame, is increased.

DISCLOSURE

Technical Problem

Accordingly, the present invention has been made keeping in mind the above problems occurring in the prior art, and an object of the present invention is to provide an opening and closing device for lift-up sliding doors and windows which has a simple structure, so that the process of manufacturing it is simplified and the manufacturing costs thereof are reduced, and by which the force required for opening or closing a pane frame can be reduced, thus increasing manipulability.

Technical Solution

In order to accomplish the above object, the present invention provides an opening and closing device for lift-up sliding doors and windows enabled a vertical including a roller unit in rolling contact with a rail provided in a lower end of a support frame, a pane frame support unit provided in a lower end of a pane frame and moving away from and approaching the roller unit in a vertical direction, a handle rotatably provided on a leading end of the pane frame, and a lift operating unit moving the pane frame support unit in a direction away from or towards the roller unit in response to rotation of the handle. The lift operating unit include: a lift operating bar provided in the leading end of the pane frame so as to be movable in a vertical direction, the lift operating bar being coupled to the roller unit, with a rack receiving slot, having a predetermined length, formed in the lift operating bar at a position adjacent to the handle; and a lift operating gear unit, comprising a drive gear coupled to the handle so that the drive gear is rotated by rotation of the handle, a driven gear increasing a rotating force of the drive gear, and a rack gear placed in the rack receiving slot of the lift operating bar so as to be movable in a vertical direction, the rack gear engaging with the driven gear and converting the rotating force into a linear motion force.

The driven gear may include a first driven gear engaging with the drive gear; and a second driven gear coaxially integrated with the first driven gear so that the second driven gear increases the rotating force of the first driven gear and transfers the rotating force to the rack gear.

The drive gear may be provided so as to be rotatable in opposite directions within a predetermined angular range, and gear teeth may be provided on a portion of a circumferential outer surface of the drive gear such that the drive gear engages with the driven gear at least within the angular range of rotation of the drive gear.

The angular range of rotation of the drive gear may be 45° or less.

The opening and closing device may further include a return spring biasing the drive gear in a direction in which the drive gear is returned to an initial position thereof.

Preferably, the opening and closing device may further include a locking control unit maintaining and releasing a lifted state of the lift operating bar.

Here, a stopper locking slot may be formed in the lift operating bar, and the locking control unit may include: a stopper releasably locked to the stopper locking slot; a stopper spring biasing the stopper in a direction in which the stopper is locked to the stopper locking slot; and a locking control switch protruding outside the pane frame towards the support frame so that, when the locking control switch is pushed inwards, a locked state of the stopper is released.

Alternatively, a stopper locking slot may be formed in the lift operating bar, and the locking control unit may include: a stopper releasably locked to the stopper locking slot; a stopper spring biasing the stopper in a direction in which the stopper is locked to the stopper locking slot; a stopper stop member maintaining and releasing a locked state of the stopper; a stop member spring biasing the stopper stop member in a direction in which the locked state of the stopper is maintained; and a locking control switch protruding outside the pane frame towards the support frame so that, when the locking control switch is pushed inwards, the locked state of the stopper is released.

The opening and closing device may further include a locking protrusion member, which has a fastening base part fastened to the support frame, a locking protrusion part protruding from the fastening base part towards the lift operating bar, and a locking head part provided on a distal end of the locking protrusion part. The lift operating bar may have, at a position corresponding to the locking protrusion member, a locking slot, which has a passing hole through which the locking head part passes and has a stop slot which extends upwards from the passing hole so that, when the lift operating bar is moved downwards, the locking head part is locked to the stop slot.

Furthermore, a locking guide surface, which is inclined from an upper end thereof to a lower end thereof towards the fastening base part, may be formed on a surface of the locking head part that faces the fastening base part.

Preferably, a lift guide slot having an upward curved arc shape may be formed in the pane frame support unit, and the roller unit may include a guide roller moving along the lift guide slot.

Here, the lift guide slot may include an upward curved section, which has a partial arc shape and extends a predetermined length from a lower end of the lift guide slot, and a horizontal section, which extends a predetermined length from an upper end of the upward curved section.

Alternatively, the lift guide slot may include an upward curved section, which has a partial arc shape and extends from a lower end to an uppermost position of the lift guide slot, and a curved seating end section, which extends downwards from the uppermost position of the upward curved section.

Advantageous Effects

As described above, the present invention provides an opening and closing device for lift-up sliding doors and windows which has a simple structure, so that the process of manufacturing it is simplified and the manufacturing costs thereof are reduced, and by which force required for opening or closing a pane frame can be reduced, thus increasing manipulability.

BEST MODE

Hereinafter, the present invention will be described in detail with reference to the attached drawings.

Figure 1:
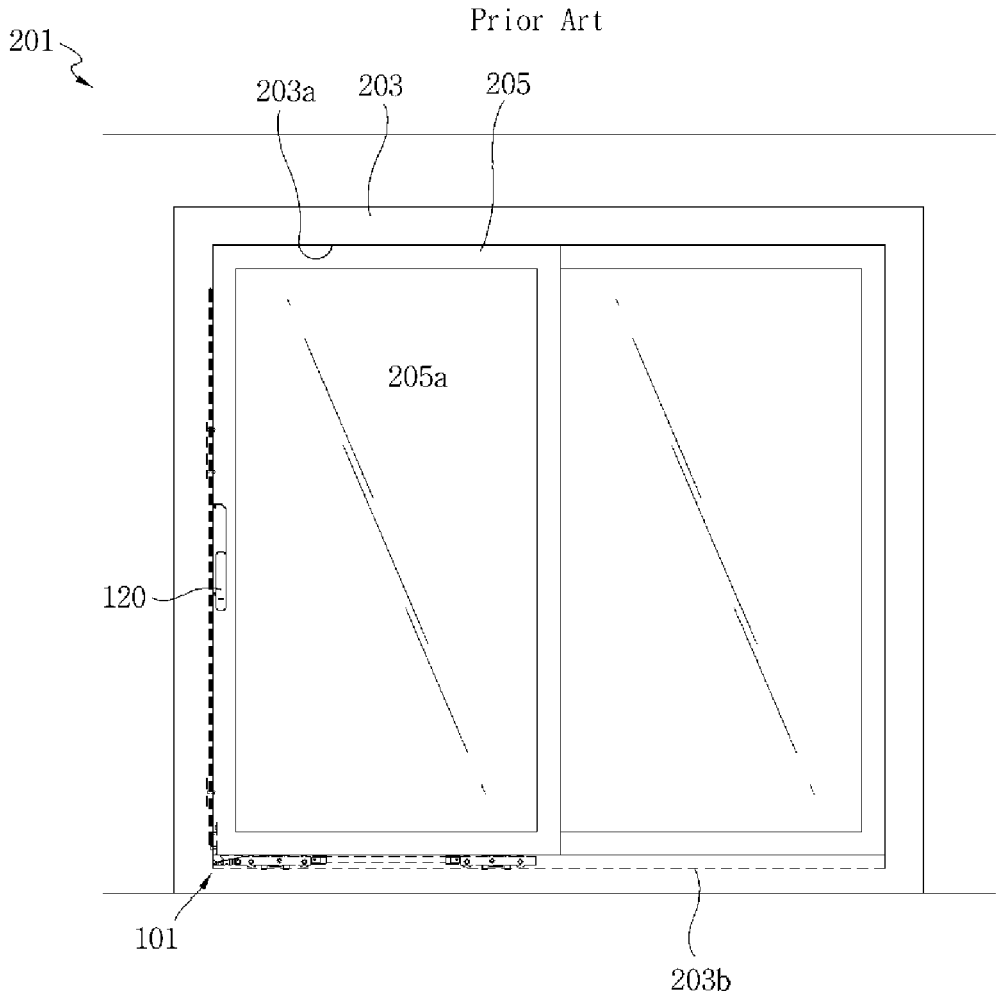
FIG. 1 is a schematic front view showing a typical lift-up sliding door or window.
Figure 2:
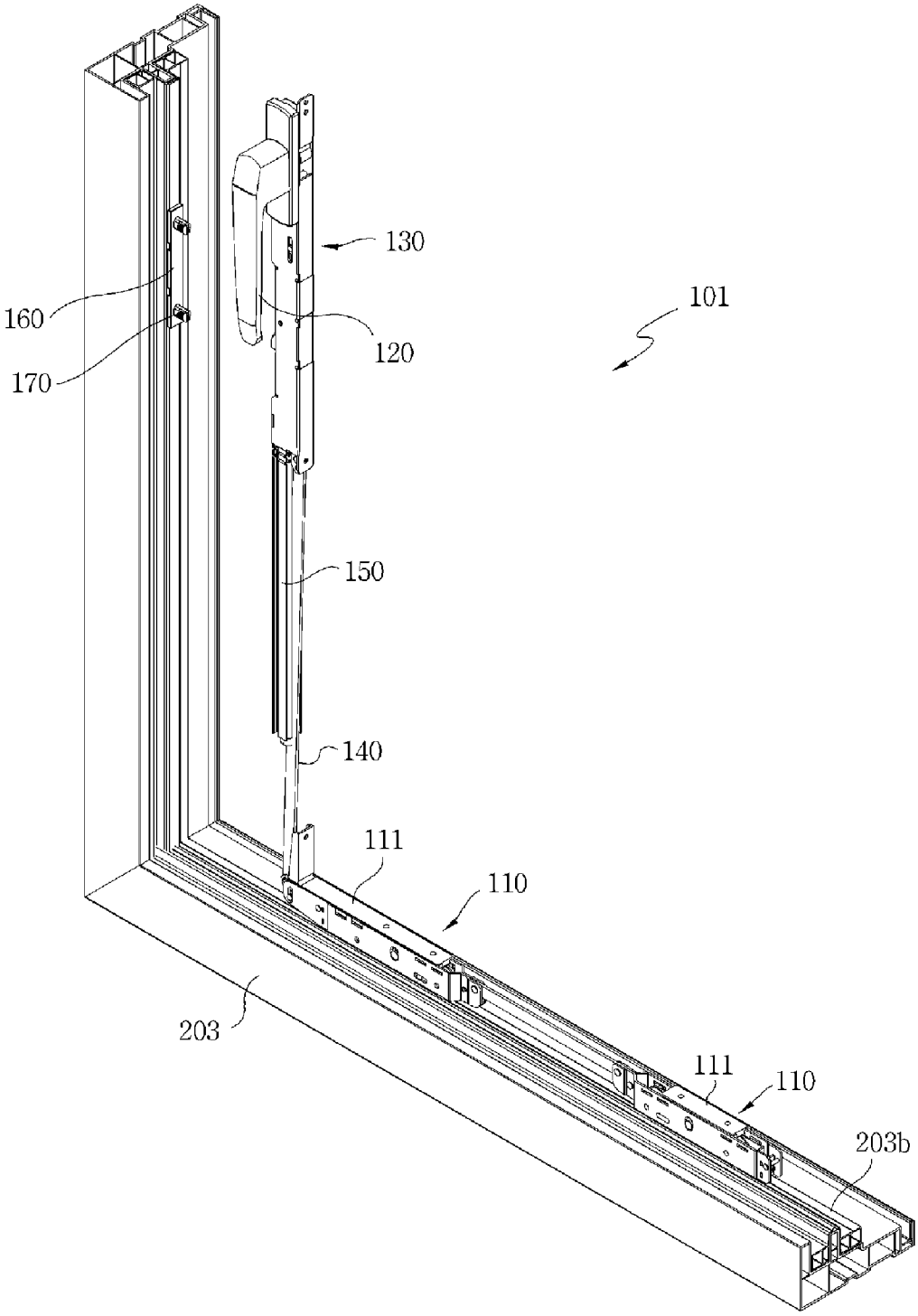
Figure 2 Prior Art
FIG. 2 is a perspective view of a conventional opening and closing device of the lift-up sliding door or window of FIG. 1.
Figure 3:
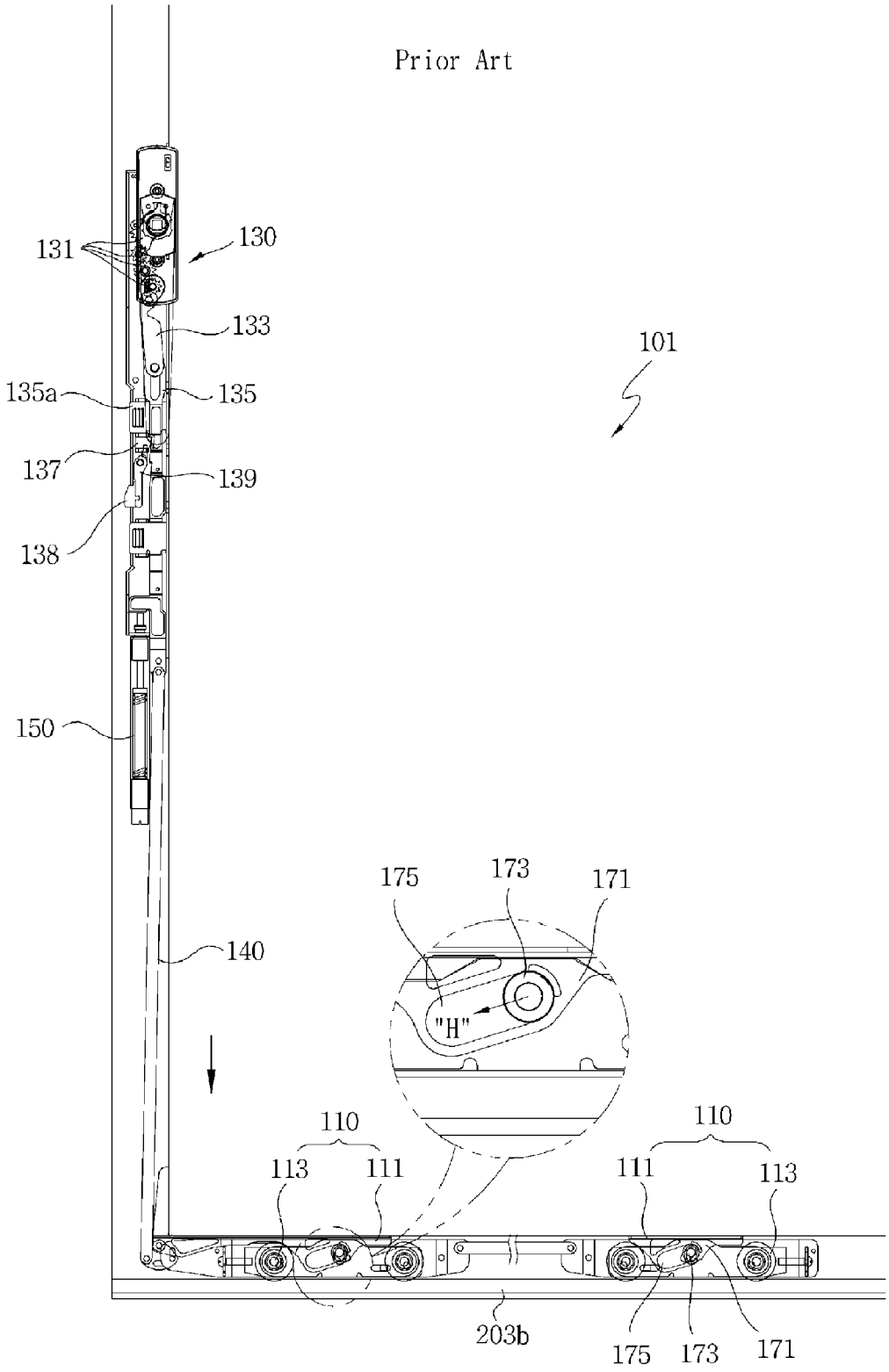
FIGS. 3 and 4 are front sectional views showing the operation of the opening and closing device of the lift-up sliding door or window of FIG. 2.
Figure 4:
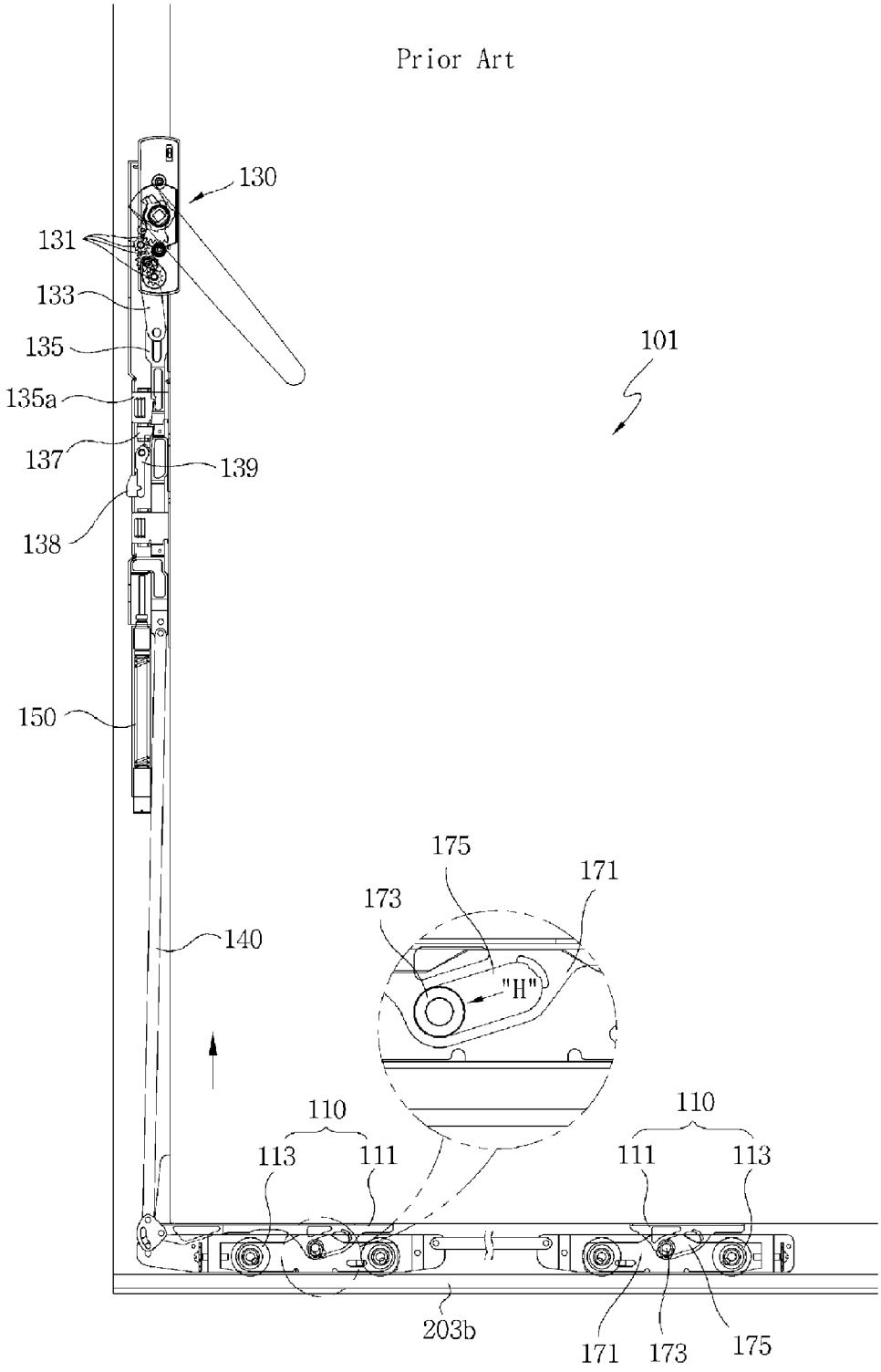
Figure 5:
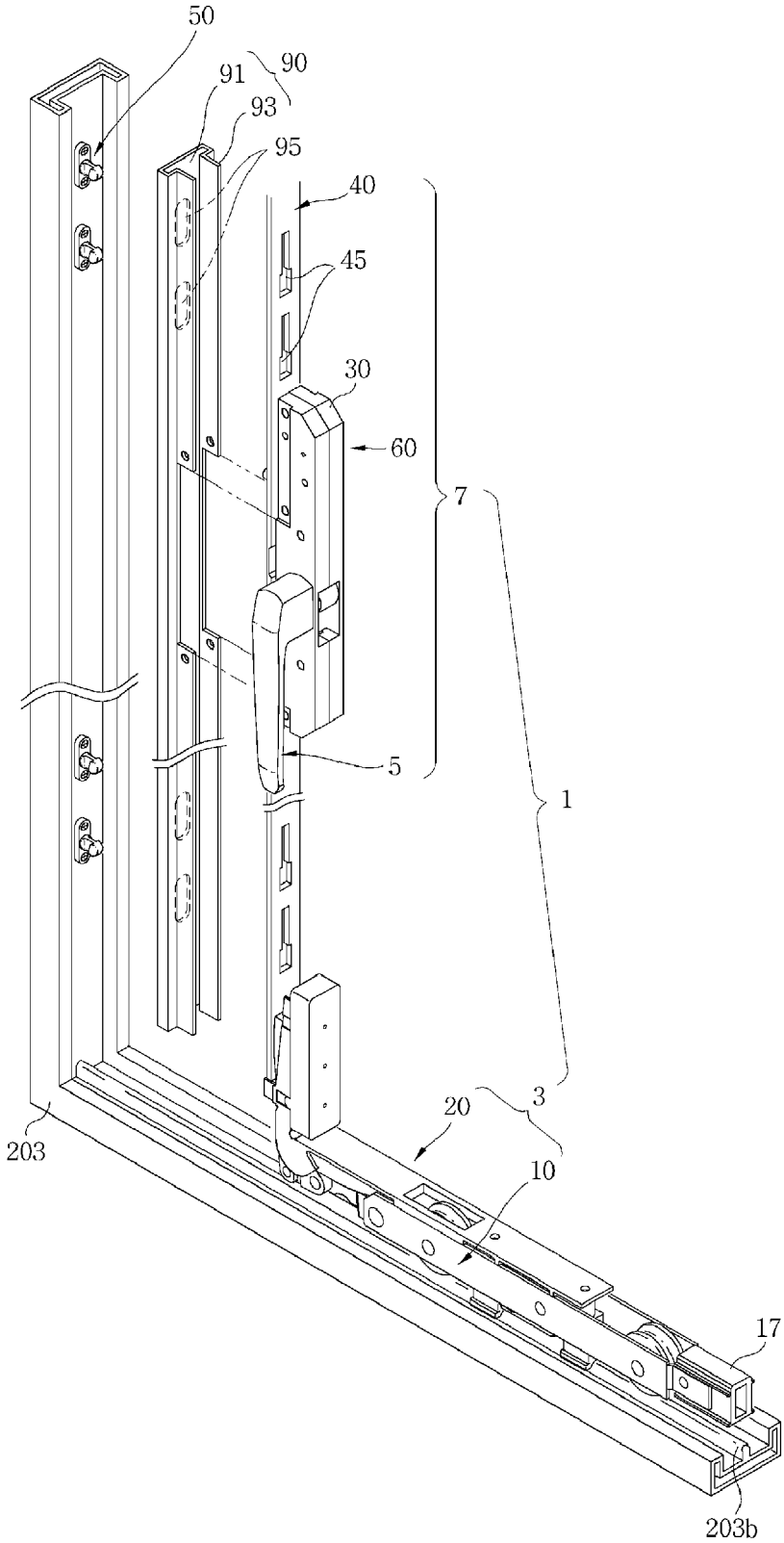
FIG. 5 is a perspective view of an opening and closing device for lift-up sliding doors and windows frame, according to an embodiment of the present invention.
Figure 6:
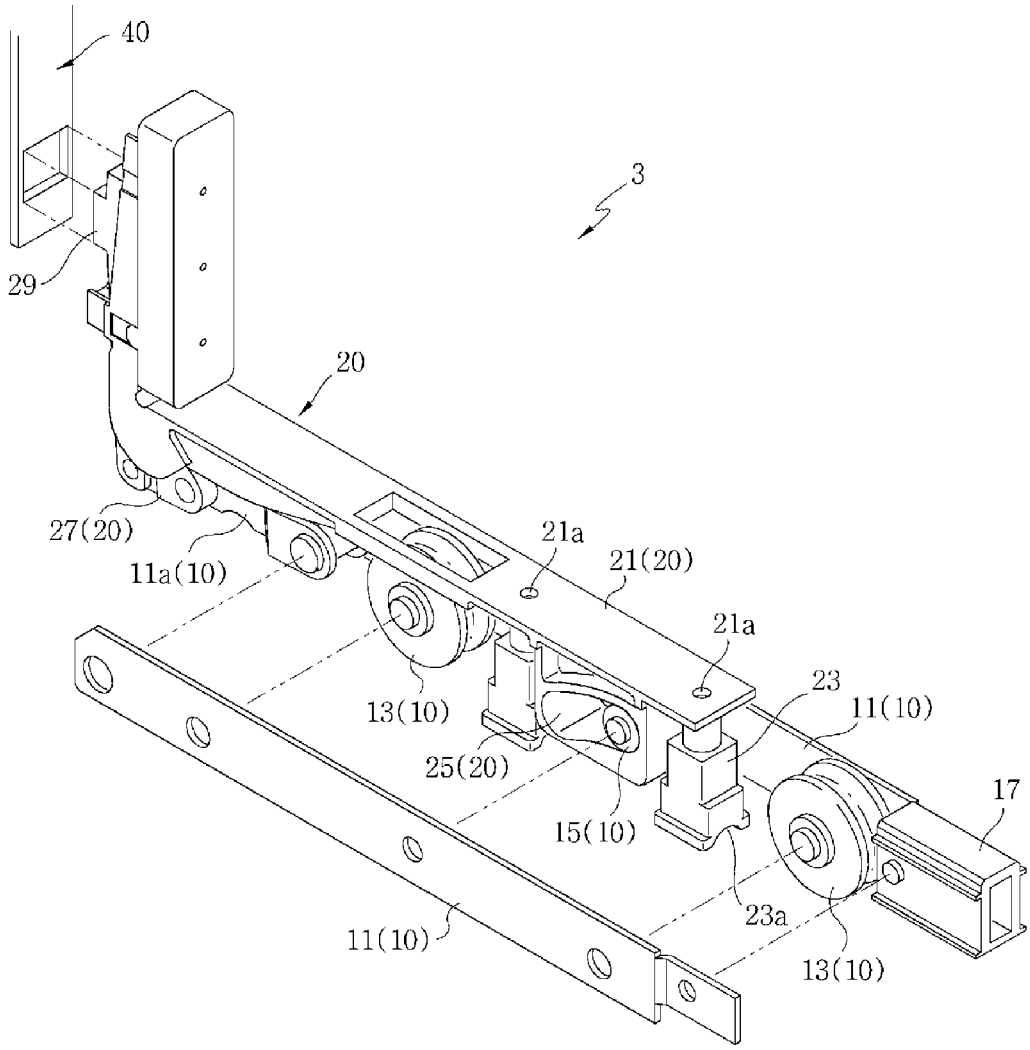
FIG. 6 is an enlarged perspective view showing a sliding lift unit of FIG. 5.
Figure 7:
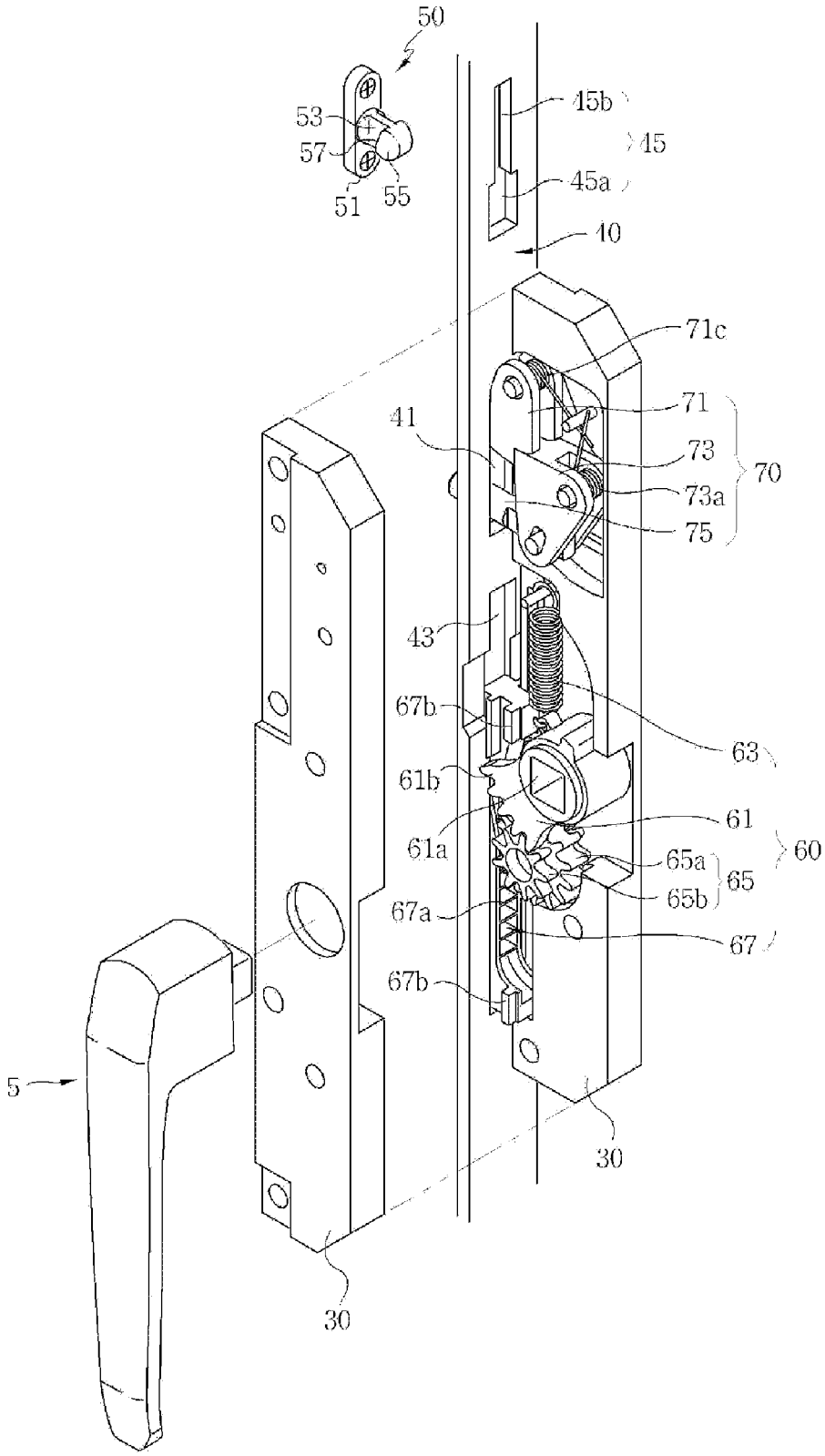
FIG. 7 is an enlarged perspective view showing a lift manipulating unit of FIG. 5.

FIG. 5 is a perspective view of an opening and closing device 1 for lift-up sliding doors and windows, according to an embodiment of the present invention. FIG. 6 is an enlarged perspective view showing a sliding lift unit 3 of the opening and closing device 1. FIG. 7 is an enlarged perspective view showing a lift manipulating unit 7 of the opening and closing device 1. As shown in the drawings, the opening and closing device 1 for lift-up sliding doors and windows according to the present invention includes the sliding lift unit 3, which is installed at a lower position in a pane frame 205 (see, FIG. 1) and supports the pane frame 205 on a rail 203*b* of a support frame 203 such that the pane frame 205 can slide along the rail 203*b* and can be lifted upwards from and brought downwards to closely contact the rail 203*b*, and the lift manipulation unit 7, which operates the sliding lift unit 3 in response to the opening or closing operation of a handle 5, which is provided at a predetermined position on the pane frame 205.

As shown in FIGS. 5 and 6, the sliding lift unit 3 includes a roller unit 10, which is in rolling contact with the rail 203*b* of the support frame 203, and a pane frame support unit 20, which is coupled to the lower end of the pane frame 205 and is movable upwards and downwards, that is, in the directions in which the pane frame support unit 20 moves away from and approaches the roller unit 10.

The roller unit 10 includes roller support plates 11, at least one roller, which is rotatably coupled to the roller support plates 11 and is brought into rolling contact with the rail 203*b* of the support frame 203, and a guide roller 15, which is rotatably coupled to the roller support plates 11 and moves along a lift guide slot 25 of the pane frame support unit 20, which will be explained later herein.

Preferably, two roller units 10 are respectively provided at longitudinal front and rear positions in the lower end of the pane frame 205. In this case, the opposite roller units 10 are connected to each other by a connection bar 17. Furthermore, a lift link 11*a* is rotatably coupled to the front ends of the roller support plates 11 of the roller unit 10, which is disposed at the front position in the lower end of the pane frame 205. The lift link 11*a* is rotatably coupled at a front end thereof to a lift hinge 27, which will be explained later herein.

The pane frame support unit 20 includes a support member 21, which is coupled to the lower end of the pane frame, rail contact members 23, which are integrally provided under the support member 21, and a lift guide slot 25, which guides the guide roller 15 of the roller unit 10 upwards and downwards.

Furthermore, a plurality of coupling holes 21*a*, through which screws for coupling the supper member 21 to the pane frame 205 are inserted, are formed in the support member 21. An upside-down U-shaped contact end 23*a*, which can be brought into contact with and be spaced apart from the rail 203*b*, is provided under the lower end of each rail contact member 23. The lift guide slot 25 has an arc shape, which is curved upwards.

Here, because the lift guide slot 25 has an arc shape curved upwards, the roller unit 10 can be smoothly moved towards and away from the pane frame 205 in vertical directions using a minimum operating force.

In detail, while the guide roller 15 is moved from the lower end towards the upper end of the lift guide slot 25, after the guide roller 15 passes over top dead center, which is designated by the character "A" in FIGS. 8 through 12, it is smoothly moved to and seated in the upper end of the lift guide slot 25 along the curved surface. Conversely, when the guide roller 15 is moved from the upper end towards the lower end of the lift guide slot 25, after the guide roller 15 passes over top dead center "A", it is smoothly moved to and seated in the lower end of the lift guide slot 25 along the curved surface by the weight of the pane frame 205. That is, in the process in which the guide roller 15 is moved along the lift guide slot 25, at the moment at which the guide roller 15 passes over the top dead center "A", the weight of the pane frame 205, which was in a distributed state, as shown by the character "a", is applied in the direction in which the guide roller 15 is moved. Therefore, the pane frame 205 can be moved away from or towards the rail 203*b* upwards or downwards using relatively small operating force.

Here, the lift guide slot 25 may have the following various shapes within the limitation that at least one section is curved upwards.

Figure 13:
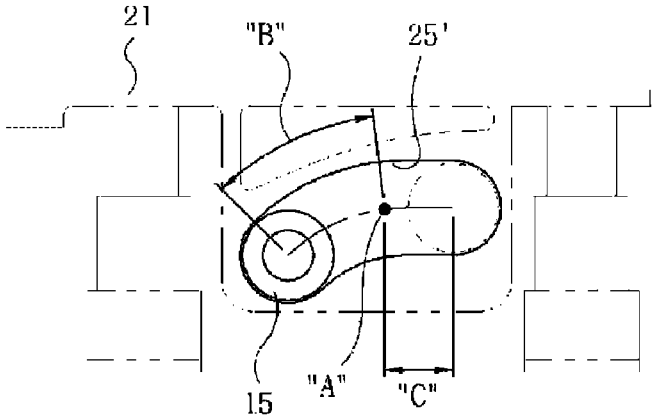
FIGS. 13 and 14 are views showing another embodiment of a guide roller and a lift guide slot of FIG. 6.

As shown in FIG. 13, it may be configured such that an upward curved section "B" having a partial arc shape is formed from the lower end to the top dead center "A" of a lift guide slot 25', and a horizontal section "C" is formed from the top dead center "A" to the upper end of the lift guide slot 25'.

Thanks to this shape, when the guide roller 15 is moved upwards, that is, when the pane frame 205 is moved downwards and thus approaches the rail 203*b*, the guide roller 15 can smoothly move along the horizontal section "C" after passing over the top dead center "A", thus preventing the pane frame 205 from being abruptly moved downwards by its own weight.

Furthermore, when the guide roller 15 is moved downwards, that is, when the pane frame 205 is moved upwards and thus is moved away from the rail 203*b*, the guide roller 15 can be moved from the horizontal section "C" of the lift guide slot 25 to the top dead center "A" using a relatively small operating force and, thereafter, can be smoothly moved along the upward curved section "B", which is formed at a lower position of the lift guide slot 25. Therefore, the operating force required for moving the pane frame 205 upwards, that is, the force required when a user manipulates the handle 5, is minimized.

Figure 14:
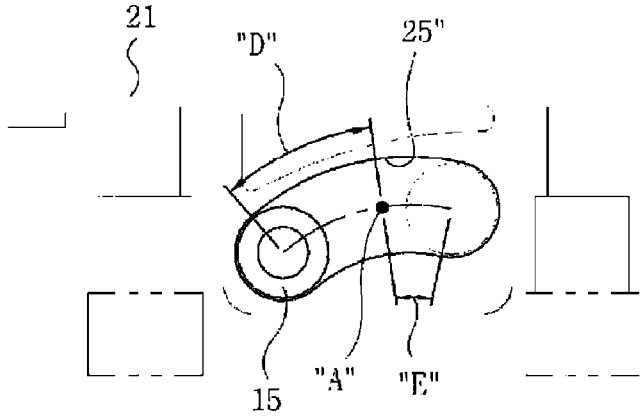

As shown in FIG. 14, a lift guide slot 25" may be configured such that an upward curved section "D" having a partial arc shape is formed from the lower end to the uppermost position of the lift guide slot 25", and a curved seating end section "E" extends downwards from the uppermost position of the upward curved section "D". In this case, when the guide roller 15 is moved toward the upper end section of the lift guide slot 25", that is, the pane frame 205 is moved downwards and thus approaches the rail 203*b*, the guide roller 15 can smoothly enter the downward seating end section "E" after passing over the top dead center "A", thus preventing the pane frame 205 from abruptly moving downwards and minimizing the operating force required.

Meanwhile, the pane frame support unit 20 is coupled to the roller unit 10 such that they can be moved away from and towards each other. Preferably, at least two pane frame support units 20 are respectively provided at front and rear positions in the lower end of the pane frame 205, in the same manner as the roller unit 10.

Here, a lift hinge 27 is provided on the front end of the pane frame support unit 20, which is disposed at the front position of the lower end of the pane frame 205, so as to be rotatable downwards and forwards with respect to the pane frame 205. In detail, the portion of the lift hinge 27 that is adjacent to the lower end of the pane frame 205 is rotatably coupled to a lift link 11*a* of the roller unit 10, and a lift connection arm 29 is rotatably coupled at a lower end thereof to a portion of the lift hinge 27 which is adjacent to the leading end of the pane frame 205. The lift connection arm 29 is coupled at an upper end thereof to a lower end of a lift operating bar 40, which will be explained later herein.

Therefore, when the lift operating bar 40 is moved upwards, the lift connection arm 29 rotates the lift hinge 27 from the lower end to the leading end of the pane frame 205. Due to the rotation of the lift hinge 27, the lift link 11*a* pulls the roller unit 10. Then, the pane frame support unit 20 is moved away from the roller unit 10.

Conversely, when the lift operating bar 40 is moved downwards, the lift connection arm 29 rotates the lift hinge 27 from the leading end to the lower end of the pane frame 205. Due to the rotation of the lift hinge 27, the lift link 11*a* pushes the roller unit 10. Then, the pane frame support unit 20 approaches the roller unit 10.

As shown in FIGS. 5 and 7, the lift operating unit 7 includes a lift operating bar 40, which is provided in the leading end of the pane frame 205, which faces the support frame 203, so as to be movable in a vertical direction, so that the sliding lift unit 3 is operated by the lift operating bar 40. The lift operating unit 7 further includes an operating bar guide member 90, which guides the vertical movement of the lift operating bar 40, and a plurality of locking protrusion members 50, which are provided on the inner surface of the support frame 203 which faces the lift operating bar 40. The lift operating unit 7 further includes a lift operating gear unit 60, which is provided in the leading end of the pane frame 205 and operates the lift operating bar 40 in a vertical direction in response to opening or closing manipulation of the handle 5, and a locking control unit 70, which prevents or allows upward movement of the lift operation bar 40.

As described above, the lift operating bar 40 is coupled at the lower end thereof to the lift connection arm 29 of the sliding lift unit 3. A stopper locking slot 41 and a rack receiving slot 43 are formed through the surface of the lift operating bar 40 at positions adjacent to the handle 5. Furthermore, locking slots 45 are formed through the surface of the lift operating bar 40 at positions corresponding to respective locking protrusion members 50, which are provided on the support frame 203.

Here, the rack receiving slot 43 has a length greater than that of a rack gear 67, which will be explained later herein. Each locking slot 45 includes a passing hole 45*a*, which has a width greater than the size of a locking head part 55 of the associated locking protrusion member 50, which will be explained later herein, such that locking head part 55 passes through the passing hole 45*a*, and a stop slot 45*b*, which extends upwards from the passing hole 45*a* and has a predetermined width such that the locking head part 55 is stopped by the lift operating bar 40.

As shown in FIG. 5, the operating bar guide member 90 is at least as long as the distance that the lift operating bar 40 is moved in a vertical direction. The operating bar guide member 90 includes an operating guide part 91, which surrounds the lift operating bar 40 such that the lift operating bar 40 is movable in a vertical direction, and a coupling part 93, which is coupled both to the leading end of the pane frame 205, which faces the support frame 203, and to a housing 30 of the lift operating gear unit 60, which will be explained later herein.

Furthermore, locking protrusion passing holes 95, corresponding to the respective locking protrusion members 50, are formed through the surface of the operating guide part 91, which faces the support frame 203.

The operating bar guide member 90 guides vertical movement of the lift operating bar 40 and serves as a finishing member, which defines the exterior shape of the leading end of the pane frame 205 in which the lift operating bar 40 is installed.

Meanwhile, each locking protrusion member 50 integrally includes a fastening base part 51, which is fastened to the support frame 203, a locking protrusion part 53, which protrudes from the fastening base part 51 towards the leading end of the pane frame 205, in which the lift operating bar 40 is installed, and a locking head part 55, which is provided on a distal end of the locking protrusion part 53. Here, the thickness of the locking protrusion part 53 is less than the width of the stop slot 45*b* of the associated locking slot 45, and the thickness of the locking head part 55 is greater than the width of the stop slot 45*b* but is less than the width of the passing hole 45*a*, so that the locking head part 55 can pass through the passing hole 45*a*.

Preferably, a locking guide surface 57, which is inclined from the upper end thereof to the lower end thereof towards the fastening base part 51, is formed on the surface of the locking head part 55 which faces the fastening base part 51. Thanks to this, when each locking protrusion member 50 is locked to a corresponding locking slot 45, which is formed in the lift operating bar 40, the lower end of the stop slot 45*b* smoothly moves along the locking guide surface 57 and thus the locking head part 55 is reliably held to the stop slot 45*b* without interference from the locking protrusion part 53, thus avoiding malfunction.

Meanwhile, the lift operating gear unit 60 and the locking control unit 70 are provided in the housing 30, which is provided in the pane frame 205 around the position at which the handle 5 is disposed.

The lift operating gear unit 60 includes a drive gear 61, which is rotated by rotating force from the handle 5, a return spring 63, which elastically biases the drive gear 61 in the direction in which the drive gear 61 is returned to the initial position thereof, a driven gear 65, which engages with the drive gear 61, and the rack gear 67, which engages with the driven gear 65, converts rotation of the handle 5 into linear motion force, and transmits this to the lift operating bar 40.

The drive gear 61 is provided in the housing 30 so as to be rotatable within a predetermined angular range. A key hole 61*a* for coupling the handle 5 to the drive gear 61 is formed in the drive gear 61 at a position facing the sidewall of the housing 30. Here, gear teeth 61*b* of the drive gear 61 may be formed within a rotating angular range only in a region in which the drive gear 61 engages with the driven gear 65. Furthermore, it is preferable that the rotating angular range of the drive gear 61 be an angle of approximately 45°. This angular range corresponds to the angle by which the handle 5 is rotated when manipulated, which is an angle by which the user can easily conduct rotation of the handle 5.

The return spring 63 is coupled at opposite ends thereof to a predetermined position on the circumferential outer surface of the drive gear 61 and to a predetermined position on the housing 30 adjacent to the circumferential outer surface of the drive gear 61. When the user rotates the handle 5, the return spring 63 is stretched by the rotation of the drive gear 61. When the user releases the handle 5, the return spring 63 elastically contracts and thus rotates the drive gear 61 to the initial position thereof. Therefore, even if no outside force is applied to the handle 5, the handle 5 is returned to the initial position thereof.

The driven gear 65 includes a first driven gear 65*b*, which engages with the drive gear 61, and a second driven gear 65*a*, which increases rotating force of the first driven gear 65*b* and transmits the rotating force to the rack gear 67. Preferably, the first and second driven gears 65*b* and 65*a* are integrated with each other. The driven gear 65 is rotatably provided in the housing 30 between the drive gear 61 and the rack gear 67.

Gear teeth 67*a*, which engage with the second driven gear 65*a*, are provided on the surface of the rack gear 67 which faces the interior of the housing 30. Furthermore, rack guides 67*b* are provided on upper and lower ends of the rack gear 67 at positions facing the interior of the housing 30 and are slidably seated in rack guide grooves 31, which are formed in the inner surface of the housing 30. A portion of the rack gear 67, which faces the lift operating bar 40, is placed in the rack receiving slot 43 of the lift operating bar 40 so as to be movable in a vertical direction.

The rack gear 67 converts rotational kinetic energy, which is transmitted from the handle 5 through the drive gear 61 and the driven gear 65 by rotation of the handle 5, into vertical linear kinetic energy, thus moving the lift operating bar 40 upwards.

That is, when the user rotates the handle 5, the rotating force is transmitted to the rack gear 67 through the drive gear 61 and the driven gear 65 so that the rack gear 67 is moved upwards. Then, the upper end of the rack gear 67 is brought into contact with the upper end of the rack receiving slot 43 of the lift operating bar 40 and thus moves the lift operating bar 40 upwards.

Thereafter, when the user releases the handle 5, the drive gear 61 and the driven gear 65 are rotated in the direction in which they are returned to initial positions thereof by the returning force of the drive gear 61. Thus, the rack gear 67 is moved downwards. At this time, the lift operating bar 40, which was moved upwards before the rack gear 67 was moved downwards, maintains the state of being held by a stopper 71 of the locking control unit 70, and only the rack gear 67 is moved downwards.

Meanwhile, the locking control unit 70 includes the stopper 71, which is removably stopped to the stopper locking slot 41 of the lift operating bar 40, a stopper stop member 73, which maintains and releases the stopped state of the stopper 71, and a locking control switch 75, which manipulates the stopper stop member 73.

The stopper 71 includes a locking stop 71*a*, to which the upper end of the stopper locking slot 41 of the lift operating bar 40 is stopped, and a locked state-maintaining stop 71*b*, which is stopped by the stopper stop member 73. Furthermore, the stopper 71 is constructed such that it is elastically rotated from the inside of the housing 30 towards the stopper locking slot 41 of the lift operating bar 40 by the elasticity of a stopper spring 71*c*.

The stopper stop member 73 is disposed adjacent to the stopper 71 such that it is elastically rotated towards the locked state-maintaining stop 71*b* of the stopper 71 by the elasticity of a stop member spring 73*a*.

The locking control switch 75 is coupled at an inside end thereof to the stopper stop member 73. The distal end of the locking control switch 75 passes through the stopper locking slot 41 of the lift operating bar 40 and protrudes outside the pane frame 205. Here, preferably, the locking control switch 75 and the stopper stop member 73 are connected to each other through a link connection structure such that the stopper stop member 73 can be rotated by linear movement of the locking control switch 75. To achieve the above purpose, an oblique link slot 75*b* corresponding to the rotational radius of the stopper stop member 73 is formed in the stopper stop member 73, and a link pivot 75*a*, which is movably inserted into the link slot 75*b*, is provided on the inside end of the locking control switch 75.

In the locking control unit 70 having the above-mentioned construction, when the locking control switch 75 is pushed inwards, the stopper stop member 73 is rotated inwards, so that the locked state between the stopper stop member 73 and the locked state-maintaining stop 71*b* of the stopper 71 is released.

Figure 15:
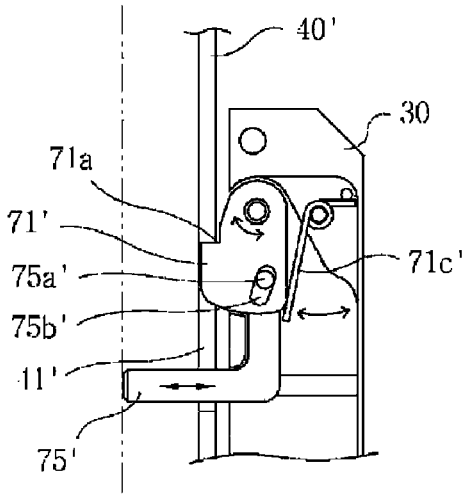
FIG. 15 is a view showing another embodiment of a locking control unit of FIGS. 7 through 12.

Meanwhile, as well as the above-mentioned construction, the locking control unit 70 may have the following construction. As shown in FIG. 15, a locking control unit 70' includes a stopper 71', which is removably stopped to a stopper locking slot 41' of a lift operating bar 40', a stopper spring 71*c'*, which maintains the stopped state of the stopper 71', and a locking control switch 75', which releases the stopped state of the stopper 71'.

In this case, a link slot 75*b'* is formed in an outer end of the stopper 71' (the lower end of the stopper as seen in the drawing), and a link pivot 75*a'* of the locking control switch 75' is movably inserted into the link slot 75*b'* of the stopper 71'.

Here, the stopper spring 71*c'* must have sufficient elasticity to maintain the stopper 71' locked to the stopper locking slot 41' of the lift operating bar 40'. As such, the structure of the locking control unit 70' can be simplified.

The operation of the opening and closing device for lift-up sliding doors according to the present invention having the above-mentioned construction will be explained herein below.

Figure 8:
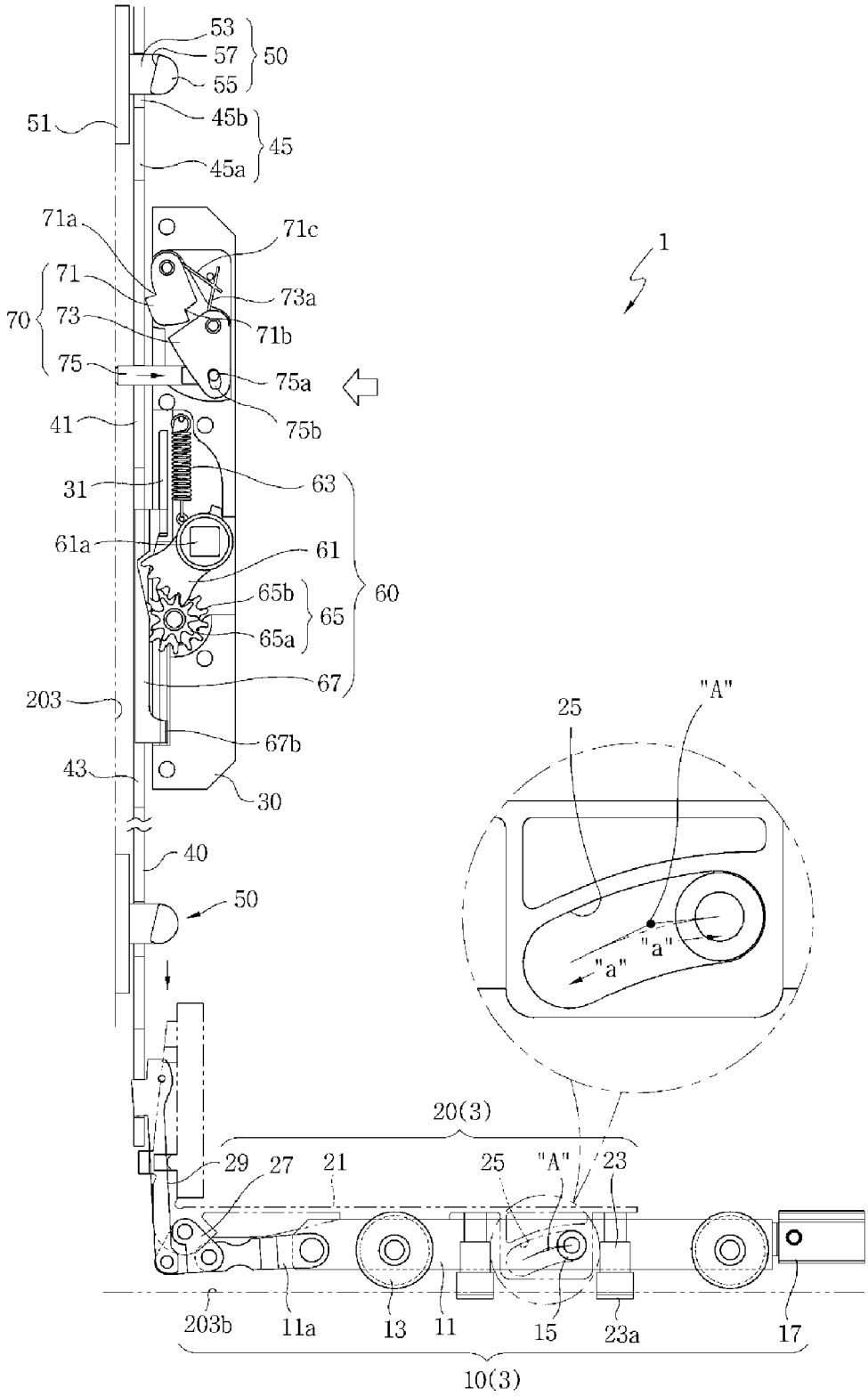
FIGS. 8 through 12 are front views showing the operation of the opening and closing device according to the present invention.

While the pane frame 205 closes an opening 203*a* of the support frame 203, the pane frame 205 is at a lower position, and the pane frame support unit 20 and the roller unit 10 are close to each other, as shown in FIG. 8.

At this time, the lift operating bar 40 is also in a descended state, and the contact ends 23*a* of the rail contact members 23 of the pane frame support unit 20 contact the rail 203*b* and compress the rail 203*b* downwards using the weight of the pane frame.

Furthermore, the locking control switch 75 of the locking control unit 70 is in a pushed state because it is in contact with the support frame 203. Thus, the stopper stop member 73 and the stopper 71 are in states of being rotated in the directions in which the lock is released. The locking heads 55 of the locking protrusion members 50, which are provided on the support frame 203, are in states of being locked to the respective stop slots 45*b* of the locking slots 45 of the lift operating bar 40. Therefore, the pane frame 205 is in a locked state.

Furthermore, the drive gear 61 of the lift operating gear unit 60 is at the initial position thereof, and the rack gear 67 is in a lower position of the rack receiving slot 43 of the lift operating bar 40. The guide roller 15 of the roller unit 10 is in the upper end of the lift guide slot 25 of the pane frame support unit 20.

Figure 9:
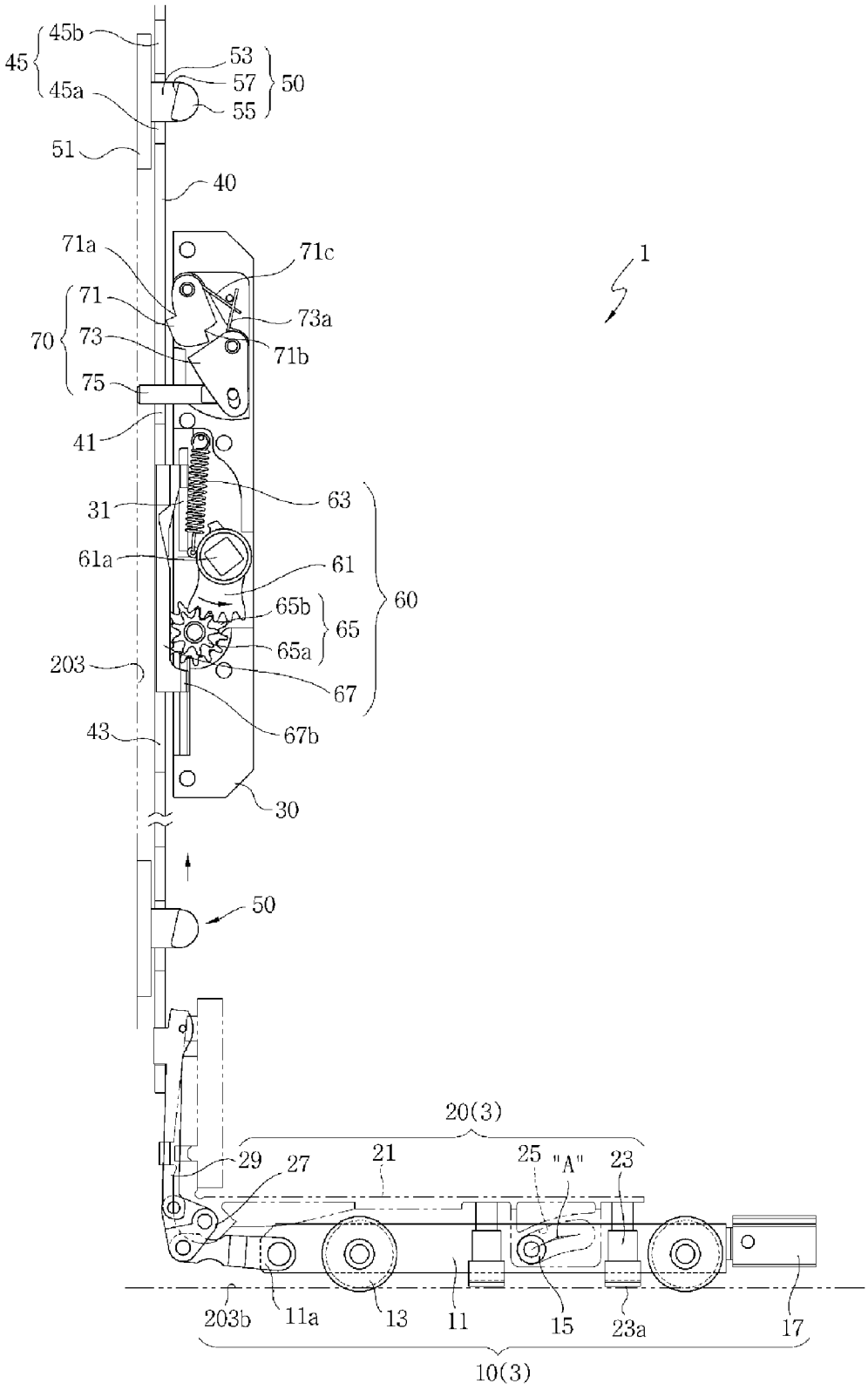
Figure 10:
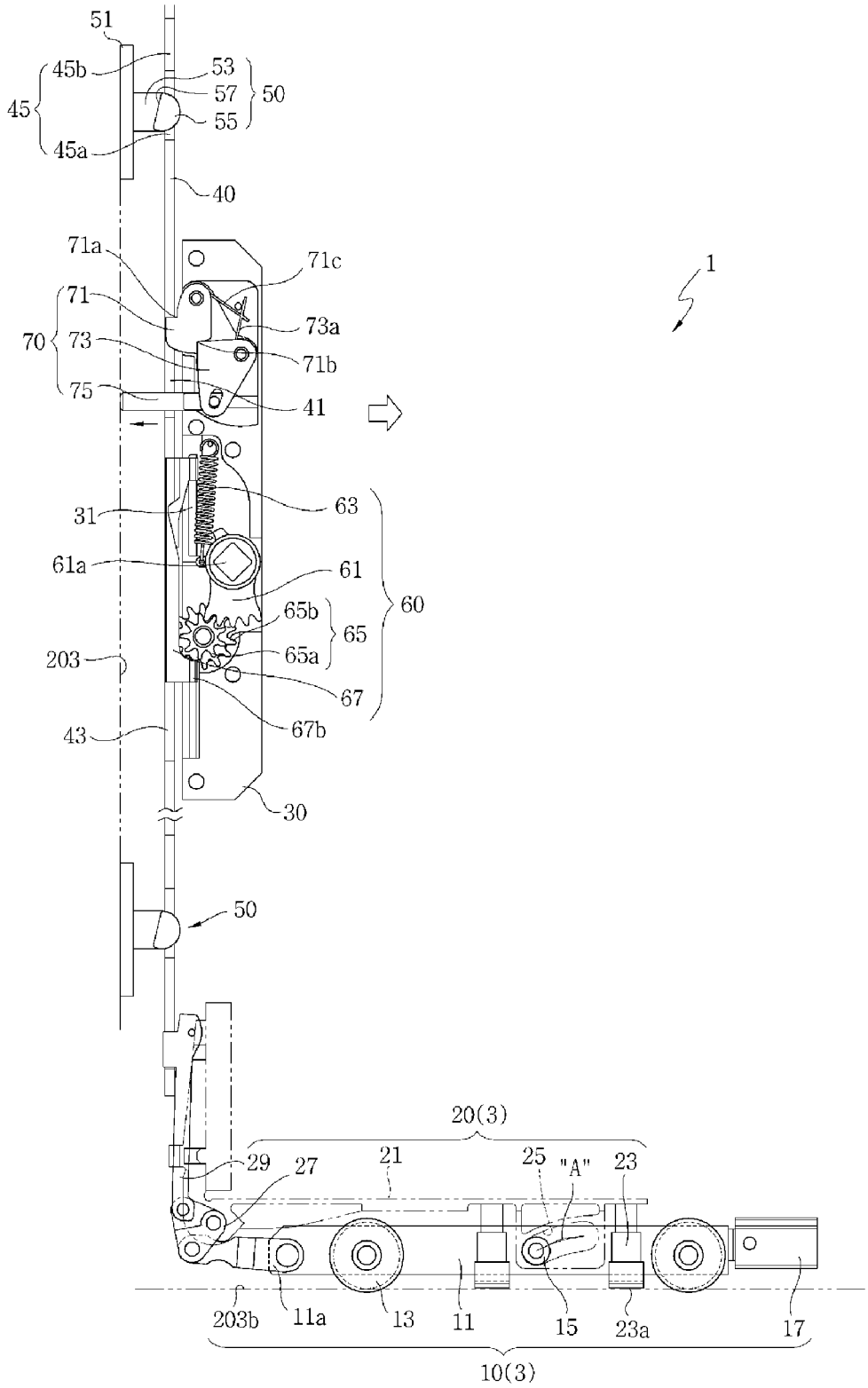

In this state, to open the pane frame 205, when the user rotates the handle 5 in the direction in which the pane frame 205 is opened, as shown in FIGS. 9 and 10, the drive gear 61 coupled to the handle 5 is rotated. Then, the second driven gear 65*a* is rotated by the rotation of the first driven gear 65*b*, which engages with the drive gear 61. Thus, the rack gear 67 is linearly moved upwards.

While the rack gear 67 is moved upwards, the upper end of the rack gear 67 pushes the lift operating bar 40 upwards by contacting the upper end of the rack receiving slot 43 of the lift operating bar 40.

As such, when the lift operating bar 40 is moved upwards, the lift connection arm 29, which is coupled to the lower end of the lift operating bar 40, rotates the lift hinge 27 of the pane frame support unit 20 from the lower end of the pane frame 205 towards the leading end of the pane frame 205. Due to the rotation of the lift hinge 27, the lift link 11*a* pulls the roller unit 10. At this time, the guide roller 15 of the roller unit 10 is moved towards the lower end of the lift guide slot 25 of the pane frame support unit 20. Thereby, the pane frame support unit 20 is moved away from the roller unit 10.

Then, the contact ends 23*a* of the rail contact members 23 of the pane frame support unit 20 are spaced apart from the rail 203*b* of the support frame 203 so that none of the weight of the pane frame 205 is transferred to the rail 203*b* through the contact members 23. Therefore, the rollers 13 are able to roll on the rail 203*b* of the support frame 203, so that the pane frame 205 enters an openable state. Here, when the user releases the handle 5 at a desired position at which the pane frame 205 is open, the return spring 63 of the drive gear 61 is elastically contracted, thus returning the drive gear 61 to the initial position thereof. At this time, the handle 5 is also returned along with the drive gear 61 to the initial position thereof even if no force is applied to the handle 5.

Furthermore, when the lift operating bar 40 is moved upwards, the locking protrusion part 53 and the locking head part 55 of each locking protrusion member 50 are placed at the passing hole 45*a* of each locking slot 45 of the lift operating bar 40, thus the locked state of the pane frame 205 is released.

Subsequently, when the pane frame 205 is moved in the direction in which the window is opened, as shown in FIG. 10, the stopper 71 and the stopper stop member 73 are rotated in the directions in which they are locked by the elasticity of the stopper spring 71*c* and the stop member spring 73*a*, so that the locking stop 71*a* of the stopper 71 is locked to the upper end of the stopper locking slot 41 of the lift operating bar 40 and, simultaneously, the stopper stop member 73 is locked to the locked state-maintaining stop 71*b* of the stopper 71, thus the lift operating bar 40 maintains the lifted state. Furthermore, the locking control switch 75 of the locking control unit 70, which was pushed inward by contact with the support frame 203, is protruded outwards from the lift operating bar 40 by the rotation of the stopper stop member 73 in the locking direction.

Figure 11:
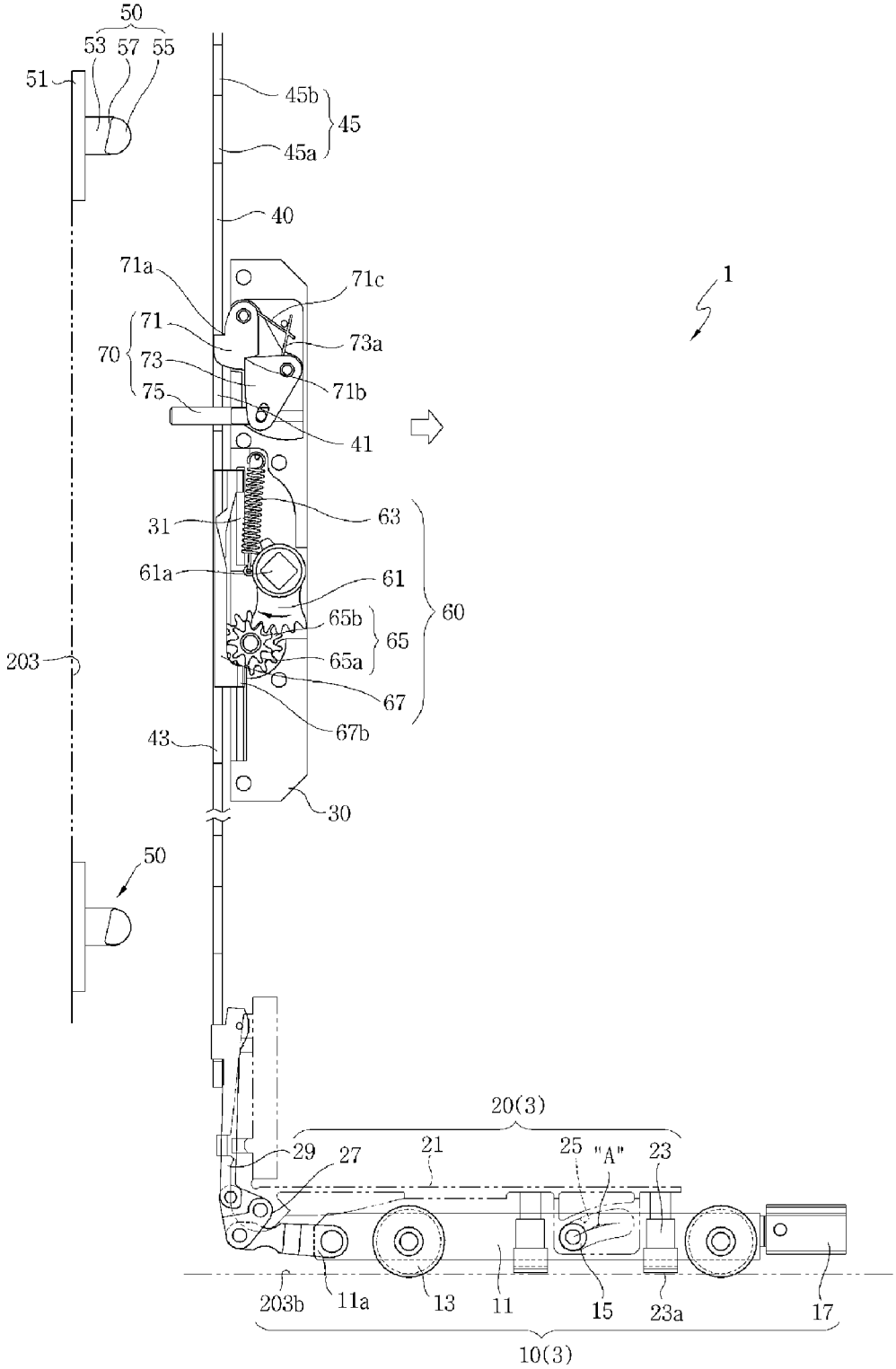
Figure 12:
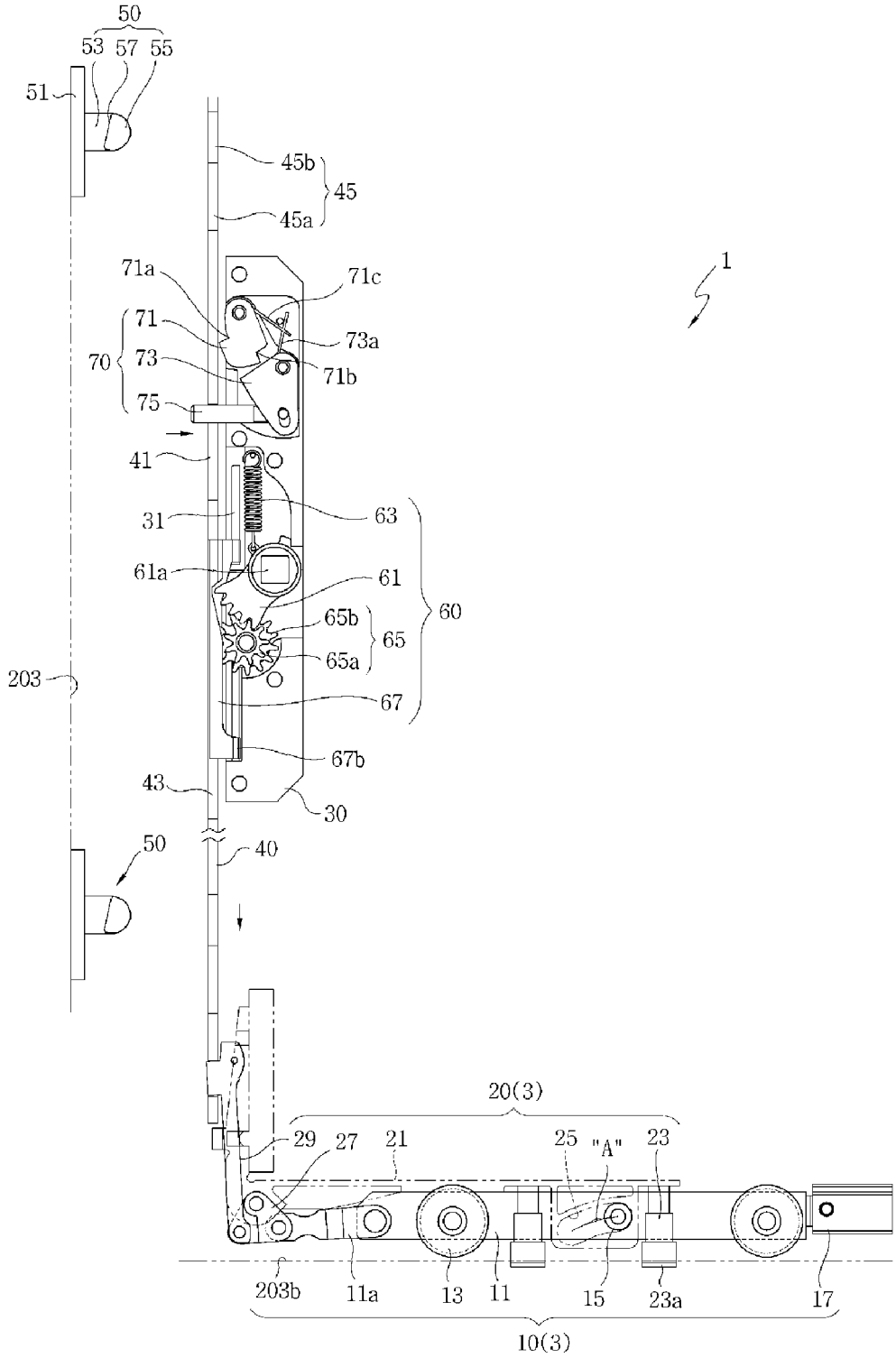

Meanwhile, as shown in FIG. 11, when the user desires to maintain the opened state of the pane frame 205 at a desired position, the user pushes the locking control switch 75 of the locking control unit 70. Thereby, as shown in FIG. 12, the stopper stop member 73 is rotated in the direction in which it is unlocked, so that the locked state of the stopper 71 is released. Then, the lift operating bar 40 is moved downwards by the weight of the pane frame 205, so that the pane frame support unit 20 approaches the roller unit 10. At this time, the contact ends 23*a* of the rail contact members 23 of the pane frame support unit 20 are brought into contact with the rail 203*b* of the support frame 203 and compress the rail 203*b* using the weight of the pane frame 205, thus preventing the pane frame 205 from sliding on the rail 203*b*. Therefore, the pane frame 205 maintains the opened state. In the above process, the guide roller 15 of the roller unit 10 smoothly moves upwards along the lift guide hole 25 of the pane frame support unit 20, thus preventing the pane frame 205 from abruptly moving downwards.

Thereafter, when the user again rotates the handle 5 to slide the pane frame 205, as described above, the pane frame support unit 20 is spaced apart from the roller unit 10 by the upward movement of the lift operating bar 40 and by the operation of maintaining the lifted state thereof, so that the pane frame 205 becomes slidable.

Meanwhile, when the pane frame 205, which has been in the opened state, is closed, as shown in FIG. 8, the locking control switch 75 of the locking control unit 70 is brought into contact with the support frame 203 and thus is pushed inwards. Thus, the locking state of the stopper 71 is released, and the lift operating bar 40 is moved downwards. Thereby, the locking head parts 55 of the locking protrusion members 50 are locked to the respective stop slots 45*b* of the locking slots 45 of the lift operating bar 40 and, simultaneously, the pane frame support unit 20 moves downwards and approaches the roller unit 10. Therefore, the pane frame 205 closes the opening 203*a* of the support frame 203 and automatically enters the locked state.

As such, in the opening and closing device for lift-up sliding doors and windows frame according to the present invention, the drive gear is rotated by rotation of the handle, and the rotational force of the drive gear is converted into linear kinetic energy through the driven gear and the rack gear. The linear kinetic energy directly moves the lift operating bar upwards. Therefore, the gear mechanism for operation of the lift operating bar is greatly simplified.

Furthermore, because the guide roller of the roller unit moves along the lift guide slot of the sliding lift unit, which has a partial arc shape that is curved upwards, the pane frame can be moved away from or towards the rail using a minimum operating force.

As well, because the stopper of the locking control unit is directly locked to or released from the stopper locking slot of the lift operating bar, the structure for locking the pane frame can be simplified.

Thanks to the above-mentioned advantages, the structure of the opening and closing device is greatly simplified, and the number of elements thereof is markedly reduced. Therefore, the process of manufacturing the device is simplified and the manufacturing costs thereof are reduced.

The invention claimed is:

1. An opening and closing device comprising a roller unit in rolling contact with a rail disposed in a lower end of a support frame, a pane frame support unit disposed in a lower end of a pane frame said pane frame support unit selectively movable away from and towards the roller unit in a vertical direction, a handle rotatably provided on a leading end of the pane frame, and a lift operating unit, selectively moving the pane frame support unit and said pane frame in the vertical direction away from and towards the roller unit in response to rotation of the handle, wherein the lift operating unit comprises:

a lift operating bar provided in the leading end of the pane frame said lift operating bar being movable in the vertical direction relative to said pane frame, the lift operating bar being coupled to the roller unit by a lift connection arm, the lift operating bar including a rack receiving slot having a predetermined length and formed in the lift operating bar at a position adjacent to the handle; and a lift operating gear unit, comprising a drive gear coupled to the handle so that the drive gear is rotated by rotation of the handle, a driven gear coupled to and increasing a rotating force of the drive gear, and a rack gear placed in the rack receiving slot of the lift operating bar so as to be movable in the vertical direction relative to the lift operating bar, the rack gear engaging with the driven gear and converting the rotating force into a linear motion force.

2. The opening and closing device according to claim 1, wherein the driven gear comprises:

a first driven gear engaging with the drive gear; and a second driven gear coaxially coupled to the first driven gear and engaging the rack gear.

3. The opening and closing device according to claim 2, wherein the drive gear is rotatable in opposite directions within a predetermined angular range, and gear teeth are provided on a portion of an outer surface of the drive gear such that the drive gear engages with the first driven gear at least within the predetermined angular range.

4. The opening and closing device according to claim 3, wherein the predetermined angular range is 45° or less.

5. The opening and closing device according to claim 4, further comprising:

a return spring biasing the drive gear towards an initial position thereof.

6. The opening and closing device according to claim 1, further comprising:

selectively releasably holding the lift operating bar in a lifted state.

7. The opening and closing device according to claim 6, wherein a stopper locking slot is formed in the lift operating bar, and the locking control unit comprises: selectively releasably engaging to the stopper locking slot; a stopper spring biasing the stopper towards the stopper locking slot; and a locking control switch protruding outside the pane frame towards the support frame wherein the locking control switch is operable to release the stopper form a locked state.

8. The opening and closing device according to claim 6, wherein a stopper locking slot is formed in the lift operating bar, and the locking control unit comprises: a stopper selectively releasably engaging to the stopper locking slot; a stopper spring biasing the stopper in a direction in which the stopper is locked to the stopper engages the stopper locking slot; a stopper stop member operable to maintain the stopper in the locked state; a stop member spring biasing the stopper stop member towards a position in which the stopper stop member maintains the stopper in the locked state; and a locking control switch protruding outside the pane frame towards the support frame, wherein the locking control switch is operable to release the stopper from the locked state.

9. The opening and closing device according to claim 1, further comprising:

a locking protrusion member, comprising a fastening base part fastened to the support frame, a locking protrusion part protruding from the fastening base part towards the lift operating bar, and a locking head part provided on a distal end of the locking protrusion part, wherein the lift operating bar has, at a position corresponding to the locking protrusion member, a locking slot, which has a passing hole through which the locking head part is able to pass and has a stop slot through which the locking head cannot pass.

10. The opening and closing device according to claim 9, wherein a locking guide surface inclined from an upper end thereof to a lower end thereof towards the fastening base part, is formed on a surface of the locking head part that faces the fastening base part.

11. The opening and closing device according to claim 1, wherein an arc shaped lift guide slot is formed in the pane frame support unit, and the roller unit comprises a guide roller movably disposed in the lift guide slot.

12. The opening and closing device according to claim 11, wherein the lift guide slot includes a upward curved section, which has a partial arc shape and extends upwardly a predetermined length from a lower end of the lift guide slot, and a horizontal section, which extends a predetermined length from an upper end of the curved section.

13. The opening and closing device according to claim 11, wherein the lift guide slot includes a upward curved section, which has a partial arc shape and extends upwardly from a lower end of the lift guide slot to an uppermost point of the lift guide slot, and a curved seating end section, which extends downwards from the uppermost point of the lift guide slot.

* * * * *